United States Patent [19]

Thornton

[11] 4,356,994

[45] Nov. 2, 1982

[54] HOLLOWARE FOR UPHILL TEEMING

[75] Inventor: James M. Thornton, Sheffield, England

[73] Assignee: Dyson Refractories Limited, England

[21] Appl. No.: 104,915

[22] Filed: Dec. 18, 1979

[30] Foreign Application Priority Data

Dec. 27, 1978 [GB] United Kingdom ..... 50008/78

[51] Int. Cl.[3] ..... B22D 41/08

[52] U.S. Cl. ..... 249/109; 164/363; 249/110; 222/591

[58] Field of Search ..... 432/233, 234; 229/37 R, 229/93; 138/145, 149, 155; 222/590, 595, 591; 164/309, 310, 363, 137; 249/108–110

[56] References Cited

U.S. PATENT DOCUMENTS

| | | | |
|---|---|---|---|
| 1,626,342 | 4/1927 | Hurst et al. | 222/591 |
| 2,269,455 | 1/1942 | Hagemeyer | 164/363 |
| 2,347,855 | 5/1944 | Varga | 138/149 X |
| 3,163,897 | 1/1965 | Sylvester | 164/309 X |
| 3,279,003 | 10/1966 | Yates | 222/595 X |
| 3,358,746 | 12/1967 | Crowe | 222/595 X |
| 3,472,943 | 10/1969 | Campbell | 222/591 |
| 3,599,708 | 8/1971 | Suzuki | 249/109X |
| 3,929,184 | 12/1975 | Reuter et al. | 164/309 |

FOREIGN PATENT DOCUMENTS

| | | | |
|---|---|---|---|
| 242365 | 11/1962 | Australia | 164/309 |
| 1470075 | 2/1967 | France | 249/109 |
| 46-3860 | 1/1971 | Japan | 164/363 |
| 1029543 | 5/1966 | United Kingdom | 164/363 |
| 1083262 | 9/1967 | United Kingdom | 222/591 |

*Primary Examiner*—David A. Scherbel

*Attorney, Agent, or Firm*—Lowe, King, Price & Becker

[57] ABSTRACT

The invention relates to the units of a pouring system for uphill teeming. Conventionally, such units are formed by a pouring trumpet having a two-part heavy duty iron casing, and by runners set in channels in a heavy cast iron base plate, requiring skillful assembly on site. When unskilled personnel are utilized there is frequently incorrect assembly and positioning, leading to jointing and cracking, faults which in turn leads to molten metal penetration during pouring with consequent damage to the cast iron casing of the trumpet and the case iron base plate with the inherent danger of a complete break-out. The objective of the invention is to alleviate the problems outlined above, that objective being met by providing the units of a pouring system for uphill teeming each comprising an outer casing, an inner refractory liner and a refractory insulating material between the outer casing and the inner liner, each unit being pre-assembled as a complete unit for delivery to a casting bay. Considerable further advantages are realized when the outer casing is of a destructible material such as a cardboard tube.

20 Claims, 5 Drawing Figures

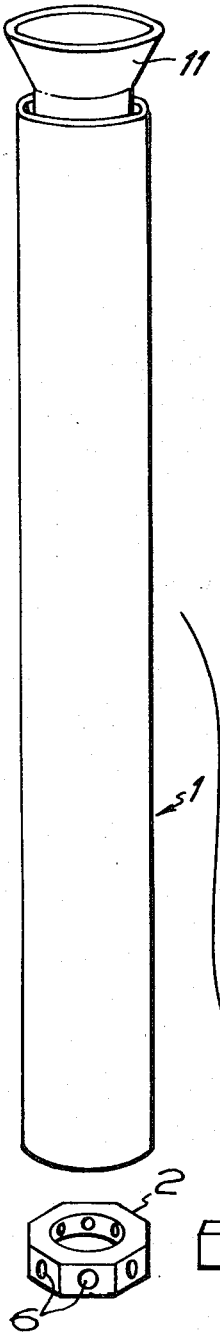
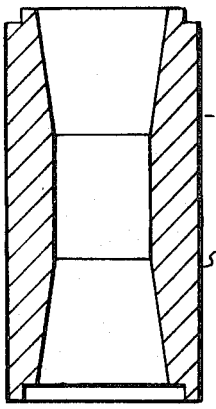
FIG. 3
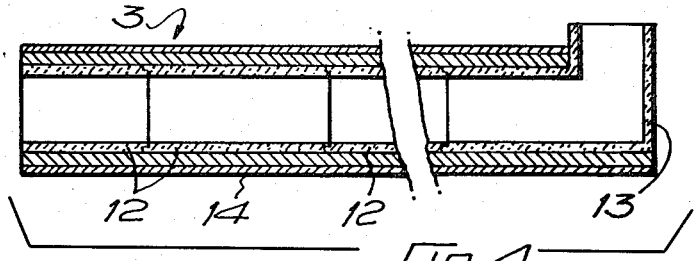
FIG. 4
FIG. 1
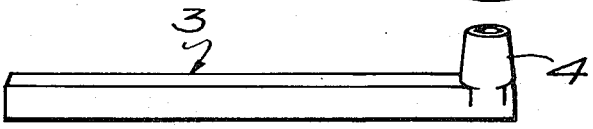
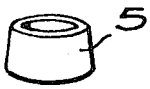

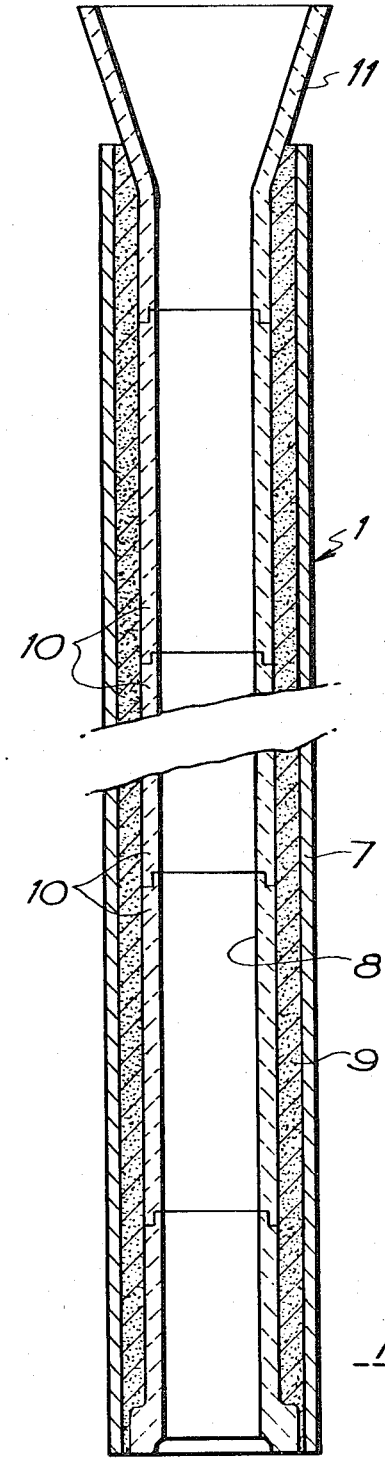
FIG. 2
FIG. 5
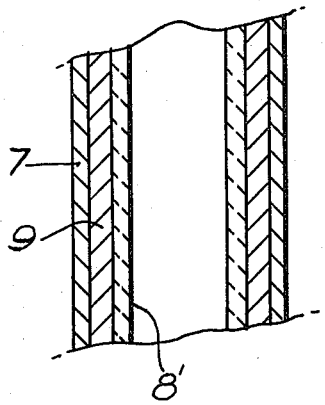

HOLLOWARE FOR UPHILL TEEMING

This invention relates to the casting of molten metal for forming ingots.

In order to improve the quality of castings where molten metal is simply poured into an ingot mould, the technique of bottom pouring or uphill teeming has been developed, where a number of ingot moulds are placed on a base plate having a plurality of channels to distribute incoming molten metal to the base of the ingot moulds. Thus, at their outer ends, the channels have an upwardly facing opening over which the moulds are positioned, and at their inner ends, the channels meet at a generally central point where a pouring trumpet or downspout is positioned. It has been common practice for refractory holloware to be used for the pouring trumpet and as linings for the channels in the base plate. Thus molten metal is teemed down and holloware forming the pouring trumpet and along the holloware lining the channels to the moulds.

Conventionally, the pouring trumpet has been formed as a one part or two part heavy duty iron casting of some 6 ft. to 12 ft. length containing the refractory holloware, which holloware is formed from a number of lengths of refractory tube suitably interlocking or otherwise jointed together. The assembly of the pouring tube must inevitably be effected on site, requiring considerable skill on the part of the operative, but even when correctly assembled has several disadvantages. Thus, any fault in a joint between two lengths of refractory allows molten metal penetration with consequent damage to the metal casting, and necessitates its subsequent cleaning and/or repair before it can be re-used. This also produces fins on the solidified metal in the pouring trumpet. Also there is the danger of refractory material breaking from the holloware and being carried by the molten metal into the mould to form an inclusion in the ingot. Much the same disadvantages are to be found in the runners laid in the channels in the base plate, where again the laying of the holloware in the heavy duty cast base plate is a highly skilled operation. Even when the positioning of the holloware is correctly effected, the running of molten metal through the runner system so formed can result in metal breakout at the joints and cracking of the holloware. This results in a great deal of steel penetration or even a complete breakout from the runner system. Thus, penetrating metal can solidify within the assembly and cause a quantity of wasted metal, damage to the supporting castings or base plates. It can also cause an ingot of poor quality. It can also involve considerable time being spent in cleaning up the base plate before further holloware pieces can be laid in place.

When, as is increasingly becoming the case, the assembly on site and positioning of the holloware is effected by unskilled labour, the above difficulties are magnified, as the jointing between adjacent holloware pieces can be ineffective, and the holloware itself actually cracked during laying.

The object of the present invention is to provide units for a pouring system for uphill teeming which substantially eliminates the abovedefined disadvantages of the prior art.

According to the present invention, the units of a pouring system for uphill teeming each comprise an outer casing, an inner refractory liner, and a refractory insulating material between the outer casing and the inner liner, each unit being pre-assembled and self-supporting as a complete unit for delivery to a casting bay.

Considerable advantages are realised by the invention. By providing a pouring system in which the units, pouring trumpet and runner sections, are pre-assembled, there is considerable simplification of the assembly of the pouring system at the casting bay. Also because each unit has a lining tightly encased by the outer casing and the interposed refractory insulating material, there is a considerable reduction in the tendency for cracks to propagate and open in the lining and hence much reduced inclusions in the resultant ingot. Even if a crack is produced, molten metal penetrating the crack meets the refractory insulating material and is prevented from reaching the outer casing. There is therefore a considerably reduced tendency for there to be a complete breakout of molten metal, and the consequent depositing of molten metal on the base plate. In addition to this, the pre-assembly of the pouring trumpet and the runner sections provides a considerably greater guarantee that the jointing of individual refractory pieces within each unit if properly effected, preventing leakage at the joints during pouring and thus preventing the formation of fins on the metal that solidifies within the enclosed pouring system. It would even be possible to eliminate completely the use of a heavy cast iron base plate, and cast iron top plate, and which would constitute a major cast saving. The pre-assembled and enclosed runner sections could simply be laid on a suitable prepared surface to connect the distributor block at the base of the pouring trumpet and the or each ingot mould.

Considerable further advantages are realised when the outer casing is of a destructibe material such as, for example, form stable fibrous refractory material or a relatively thick (e.g., ½ inch walled) cardboard tube. Preferably the cardboard tube and the like outer casing is coated or impregnated with a flame retardant material, and may be covered with a light splash can of metal, ceramic or fibre for short term protection from splash and radiation, particularly over the bottom end. With the outer casing formed from a destructible material, stripping of the pouring trumpet and the runners to recover the metal solidified therein becomes considerably less troublesome than conventional prior art techniques. After the metal has solidified, the heat passing through the liner and the refractory insulating material to the outer casing evidently causes it to burn and be at least partially consumed and the enclosed pouring system can then be self-collapsing from around the metal in the pouring trumpet and runner. This has a significant effect on handling costs as it obviates the need to provide equipment for the removal particularly of conventional trumpets to a stripping station where the heavy cast outer casing is to be physically removed.

Another major advantage of using a cardboard tube as the outer casing results from its manufacture from re-cycled paper water. As a direct consequence of this the cost of production of the cardboard tube and the amount of fuel required in the production process is considerably less than as the case in the production of a conventional cast iron trumpet casing. Even if in very special circumstances it is felt that a metal outer case is required, in the construction of the invention, it would be significantly lighter and cheaper to produce than the conventional cast iron casing presently in use.

The insulatory material may be any appropriate refractory material such as sand with an appropriate binder which can be temporary or permanent. Thus, the sand may be $CO_2$ hardened, bonded by esters or by any suitable foundary binder. It could also be a foamed refractory material, which has the advantage of ease of pouring a liquid mix into the outer casing, the liquid mix containing refractory material and a foaming agent, to produce the insulating material. It would be adequate for the insulatory material to be bonded only at each end of the unit.

The refractory liner may be formed by lengths of pre-fired refractory tubes, or dependent on the nature of the refractory insulatory material, may be formed by a coating of a suitable refractory wash on the refractory insulatory material.

According to a preferred feature of the invention, at least one of the refractory components forming the inner liner of a complete pouring trumpet can have a bore of reduced cross-section to provide a constraint on the flow of molten metal through the pouring trumpet. Thus, the section having a reduced bore can have an upper section with a tapering bore to reduce gradually the diameter of the bore and a lower section also with a tapered bore to gradually increase the diameter of the bore from a central section having the reduced bore diameter required. Preferably the section of reduced bore diameter is formed from a refractory material having greater errosion resistance than the other sections forming the liner.

It is also preferred that the upper end of the pouring trumpet of the invention is connected directly to the outlet from a ladle and whereby the stream of molten metal from the ladle to the pouring trumpet is completely shrouded to assist in the reduction in oxidation of the molten metal being poured.

The invention will now be described by way of example only with reference to the accompanying drawings in which:

FIG. 1 is an exploded view of part of a runner system in accordance with the invention;

FIG. 2 is a sectional side elevation of a pouring trumpet in accordance with the invention;

FIG. 3 is a sectional side elevaion of a section of part of the liner of a pouring trumpet;

FIG. 4 is a sectional side elevation of a runner section in accordance with the invention; and FIG. 5 is a partial sectional side elevation of an alternative embodiment of a pouring trumpet in accordance with additional aspects of the invention.

In FIG. 1, a runner system for uphill teeming has a pouring trumpet 1, a distributor block 2, a runner section 3 having an end block 4, and a cone 5 for the connection of an ingot mould (not shown). Only one runner section has been shown, but it will be understood that a runner section 3 will be connected to each of the outlet holes 6 of the distributor block (six in the version shown in FIG. 1).

As is shown by FIG. 2, the pouring trumpet is a pre-assembled complete unit formed by an outer casing 7, an inner liner 8 and refractory insulating material 9 disposed between the casing and the liner. The casing 7 is a thick cardboard tube (e.g. ½" wall thickness) and the inner liner 8 is formed from a number of refractory holloware members 10 with spigot and socket joints, the uppermost member constituting a trumpet 11 into which molten metal can be poured. Thus, the holloware members 10 are first set vertical, preferably around a vertical support pole for stability with care being exercised to ensure that the spigot and socket joints between adjacent members 10 are correctly engaged. The cardboard casing 7 is then placed over the members 10 and the trumpet member 11 is finally placed in position. Through the gap between the upper end of the casing and the upper end of the liner, an appropriate refractory material is poured to fill the annular gap between the liner and the casing. The refractory material may be hardenable by any conventional foundary technique such as $CO_2$ hardening or bonding by esters or other foundary binders. It may equally be a foamable refractory material, a material that can be used with advantage because of the ease of filling the annular gap with the refractory material containing its foaming and setting agent. Once the refractory insulating material 9 is hardened, the assembly can be removed from the supporting pole ready for despatch to a casting bay.

Preferably, prior to despatch, the outer surface of the cardboard casing 7 is coated with a flame retardant material.

Similar considerations apply to the horizontal runner sections 3, as is shown by FIG. 4. Here again the inner liner is formed from a number of holloware sections 12 with spigot and socket joints between adjacent members. Here again each of the members 12 can be set one upon the other in a vertical disposition starting with a connector block 13 with care again exercised to ensure that the spigot and socket joints are correctly engaged. A cardboard outer casing 14 is then placed around the members 12 and an appropriate refractory material poured into the annular gap between the members 12 and 13 and the cardboard casing 14. As with the pouring trumpet, the refractory insulating material may be hardened by any appropriate foundry technique, and again a foamable refractory material can be used.

Thus, in accordance with the invention, an extremely light-weight, robust, readily transportable pouring funnel and runner sections can be produced, the pre-assembly of which produce a very effective guarantee that the refractory members are properly assembled and encased in the refractory insulating material. On their arrival at the casting bay they can very easily be placed in position either on a prepared surface or in the channels of a conventional cast iron base and connected to the distributor block 4.

Once pouring has taken place the dissipation of heat through the liner and the refractory insulating material means that after a discrete interval of time the temperature of the cardboard casing is raised to such an extent that it ignites, but this interval of time is considerably longer than the time taken for the molten metal in the pouring trumpet and in the runner sections to have solidified. The effect is that the stripping of the pouring trumpet and the runner sections from the solidified metal is greatly facilitated as there are no heavy cast iron castings which must be allowed to cool and then manhandled from around the solidified metal. Also, because the liner has been correctly assembled, leakage at the joints is substantially eliminated, and the encasing of the liner with refractory insulating material has a marked effect on the reduction of cracking in surface, cracking during installation being completely eliminated by the invention. Even if in extreme circumstances a crack is formed in the liner, or leakage occurs at a joint, penetrating molten metal on reaching the refractory insulating material freezes and the possibility of there being a complete break-out is also substantially eliminated. As a result, a clean body of solidified metal is removed from the runner units.

As is shown by FIG. 3 at least one of the sections 10 forming the lining of the pouring trumpet can be replaced by a member 15 the bore through which is reduced in comparison with the bores of the remaining members 10. Thus, a constraining block can be provided, the bore of which may have a shape somewhat akin to a venturi so that there is a smooth transition from the bore diameters to either side of the constraining block to the minimum diameter of the bore of the constraining block. By providing such a member, a constraint is provided over the flow of molten metal from a ladle through the pouring trumpet and thereby controlling the flow of molten metal into the system with its advantageous effect on the production of sound ingots.

In accordance with the alternative embodiment shown in FIG. 5, an inner liner 8′ may be formed from a suitable refractory wash on the refractory insulatory material 9. The pouring trumpet, or similar unit, is completed by the outer casing 7.

I claim:

1. Units of an uphill teeming system for free pouring of molten-ferrous metal or the like at atmospheric pressure and molten metal temperatures, each said unit comprising a continuous unitary outer casing, an inner refractory liner in said outer casing, and refractory insulating material between said outer continuous casing and inner refractory liner, each said unit being preassembled and self-supporting as a complete unit adapted for delivery to a casting bay for incorporation in said uphill teeming system, said outer continuous casing being substantially tight against said inner refractory insulating material substantially along the length and around the circumference so as to retain said inner refractory liner and said refractory insulating material in position and resist cracks to thereby assist in substantially reducing inclusions in the metal being poured.

2. Units of a system as in claim 1, wherein the outer casing is of a heat destructible by the heat of the molten-ferrous metal and at least partially consumable material.

3. Units of a system as in claim 2, wherein the outer casing includes a flame retardant material.

4. Units of a system as in any of claims 2 or 3, wherein the outer casing is covered with a light splash can of a material providing for short term protection from splash and radiation.

5. Units of a system as in any of claims 1, 2 or 3, wherein the insulatory material is an appropriate refractory material.

6. Units of a system as in claim 5, wherein the refractory material contains a binder.

7. Units of a system as in claim 6, wherein the refractory material is $CO_2$ hardened.

8. Units of a pouring system as in claim 6, wherein the refractory material is bonded by esters.

9. Units of a system as in claim 6, wherein the refractory material is bonded by a foundry binder.

10. Units of a system as in any of claim 6, wherein the insulatory material is bonded at each end only of the unit.

11. Units of a system as in any of claims 1, 2 or 3, wherein the insulatory material is a foamed refractory material.

12. Units of a system as in any of claims 1, 2 or 3, wherein the refractory liner is formed by lengths of pre-fired refractory tubes.

13. Units of a system as in any of claims 1, 2 or 3, wherein the refractory liner is formed by a coating of a suitable refractory wash on the refractory insulatory material.

14. Units of a system as in any of claims 1, 2 or 3, and wherein said units include a complete pouring trumpet and wherein a portion of the inner liner of the pouring trumpet has a bore of reduced cross-section to provide a constraint on the flow of molten metal through the pouring trumpet.

15. Units of an uphill teeming system for use in free pouring of molten metal at atmospheric pressures, each said unit including a continuous integral outer casing, an inner refractory liner in said continuous integral outer casing, and a refractory insulating material layer between said outer continuous integral casing and said inner refractory liner, said continuous integral outer casing consisting of a material destructible by the heat of the molten metal, said inner refractory liner including a plurality of refractory holloware members including respectively spigot and socket ends, said plurality of members being interjoined and connected to constitute said inner refractory liner, each said unit being preassembled and self-supporting as a complete unitized entity adapted for delivery to a casting bay for incorporation in a said uphill teeming system.

16. Units of an uphill teeming system for free pouring of molten metal at atmospheric pressure, each said unit comprising a continuous integral outer casing of heat destructible material including a stable fibrous refractory material, an inner refractory liner in said outer casing, and refractory insulating material between said outer continuous casing and inner refractory liner, each said unit being pre-assembled as a complete unit adapted for delivery to a casting bay for incorporation in said uphill teeming system.

17. Units of a system as in claim 16, wherein the outer casing includes a flame retardant material.

18. Units of an uphill teeming system for free pouring of molten metal at atmospheric pressure, each said unit comprising a continuous integral outer casing of heat destructible material including a cardboard tube, an inner refractory liner in said outer casing, and refractory insulating material between said outer continuous casing and inner refractory liner, each said unit being pre-assembled as a complete unit adapted for delivery to a casting bay for incorporation in said uphill teeming system.

19. Units of a system as in claim 18, wherein the outer casing includes a flame retardant material.

20. Units of an uphill teeming system for free pouring of molten metal at atmospheric pressure, each said unit comprising a continuous integral outer casing, an inner refractory liner in said outer casing, and refractory insulating material between said outer continuous casing and inner refractory liner, said refractory liner being formed by coating of a suitable refractory wash on the refractory insulating material, each said unit being preassembled and self-supporting as a complete unit adapted for delivery to a casting bay for incorporation in said uphill teeming system.

* * * * *